United States Patent [19]

Kadija

[11] 4,258,081

[45] Mar. 24, 1981

[54] METHOD FOR PRODUCING LIQUID PERMEABLE DIAPHRAGMS FOR AN ELECTROLYTIC CELL

[75] Inventor: Igor V. Kadija, Cleveland, Tenn.

[73] Assignee: Olin Corporation, New Haven, Conn.

[21] Appl. No.: 88,796

[22] Filed: Oct. 29, 1979

[51] Int. Cl.[3] ..... C25B 1/46

[52] U.S. Cl. ..... 427/121; 204/295; 427/126.1; 427/243; 427/359; 427/428; 427/430.1

[58] Field of Search ..... 204/282, 283, 284, 290 R, 204/295, 296; 427/121, 126.1, 243, 296, 359, 428, 430.1, 434.4

[56] References Cited

U.S. PATENT DOCUMENTS 4,165,271 8/1979 Kadija ..... 204/295

*Primary Examiner*—Ralph S. Kendall

*Attorney, Agent, or Firm*—James B. Haglind; Donald F. Clements

[57] ABSTRACT

A method is provided for producing liquid permeable diaphragms for an electrolytic cell having a plurality of foraminous electrodes and a space between each pair of adjacent electrodes. The method comprises covering the foraminous electrodes with a liquid permeable thermoplastic support fabric and contacting the covered electrodes with a slurry of an electroactive material. Roller means are placed in the space between the pair of electrodes, the roller means comprising two rollers spaced apart, each of the rollers contacting only one of the pairs of electrodes, and moving the roller means to force the electroactive material into the liquid permeable thermoplastic support fabric whereby liquid permeable diaphragms are produced.

10 Claims, 3 Drawing Figures

METHOD FOR PRODUCING LIQUID PERMEABLE DIAPHRAGMS FOR AN ELECTROLYTIC CELL

This invention relates to diaphragm-type electrolytic cells for the electrolysis of aqueous salt solutions. More particularly, this invention relates to a method of producing a permeable diaphragm.

It is known in the prior art to form a liquid permeable diaphragm by depositing asbestos fibers. A slurry of fibers is formed in a container and electrodes having foraminous surfaces are immersed in the slurry. A vacuum is applied to the electrodes to deposit the fibers on the electrode to form a mat which serves as a liquid permeable diaphragm.

Recently, however, permeable diaphragms have been developed which are produced by impregnating a support fabric with a siliceous material in particulate form. In the electroactive areas of the diaphragm, the siliceous material should be uniformly distributed in the support material at a sufficient concentration to provide optimum current efficiencies and low cell voltages. This is not accomplished using, for example, vacuum deposition methods. Vacuum deposition provides a superficial layer of the siliceous material which is too shallow for satisfactory performance. Similarly, spraying a suspension of the siliceous material with, for example, a liquid or air gun gives only superficial deposition.

It is an object of the present invention to provide a method for producing liquid permeable diaphragms for an electrolytic cell by impregnating support fabrics with electroactive materials.

Another object of the present invention is to provide a method for producing liquid permeable diaphragms which are uniformly impregnated with electroactive materials.

A further object of the present invention is to provide a method for producing liquid permeable diaphragms in which a support fabric is impregnated with electroactive materials at controlled depth levels.

These and other objects of the present invention are accomplished in a method for producing liquid permeable diaphragms for an electrolytic cell having a plurality of foraminous electrodes and a space between each pair of adjacent electrodes which comprises:

(a) covering the foraminous electrodes with a liquid permeable thermoplastic support fabric, (b) contacting the covered electrodes with a slurry of an electroactive material, (c) placing roller means in the space between said pair of electrodes, the roller means comprising two rollers spaced apart, each of the rollers contacting only one of the pair of electrodes, and (d) moving the roller means within the space between the pair of electrodes to force the electroactive material into the liquid permeable thermoplastic support fabric whereby the liquid permeable diaphragms are produced.

Accompanying FIGS. 1–3 illustrate the present invention. Corresponding parts have the same numbers in all FIGURES.

Figure 1:
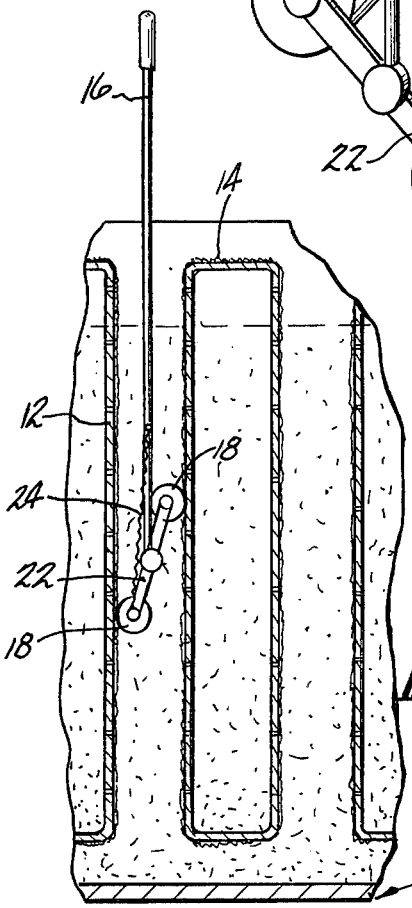
FIG. 1 is a partial schematic view of apparatus used in the present invention.
Figure 2:
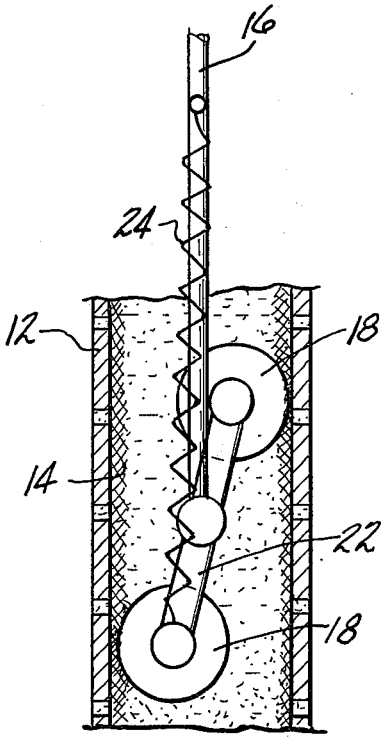
FIG. 2 is an enlarged partial section of the embodiment of FIG. 1.

In FIGS. 1 and 2, container 10 is partially filled with a slurry of an electroactive material used as the impregnating agent. Immersed in the slurry are foraminous electrodes 12 covered with support fabric 14. Roller means 16 having rollers 18 is placed in container 10 so that rollers 18 are immersed in the slurry and in contact with support fabric 14. Vertical movement of roller means 16 forces the slurry into support fabric 14 to impregnate support fabric 14 with the electroactive material.

Figure 3:
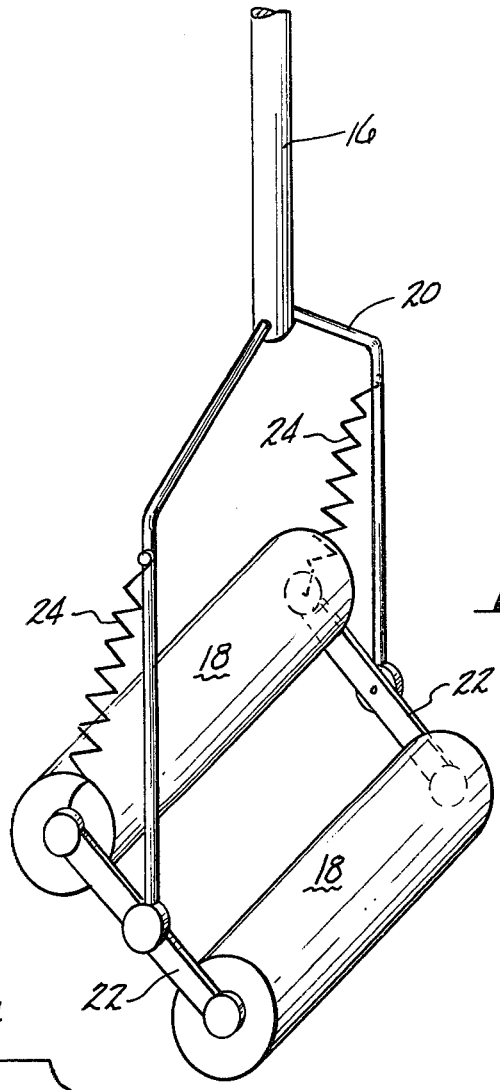
FIG. 3 is a perspective view of roller means employed in the present invention.

Roller means 16 illustrated in FIG. 3 has a frame 20 which is pivotally attached to bars 22 which join and space apart rollers 18. Springs 24 attached to frames 20 and bars 22 provide means for regulating the pressure of rollers 18.

In producing liquid permeable diaphragms by the novel method of the present invention, a support fabric is employed which is produced from thermoplastic materials which are chemically resistant to and dimensionally stable in the gases and electrolytes present in the electrolytic cell. The fabric support is substantially non-swelling, non-conducting, and non-dissolving during operation of the electrolytic cell. The support fabric is non-rigid and is sufficiently flexible to be shaped to the contour of an electrode, if desired.

Suitable support fabrics are those which can be handled easily without suffering physical damage. This includes handling before and after they have been impregnated with the electroactive component. Support fabrics are employed which can be removed from the cell following electrolysis, treated or repaired, if necessary, and replaced in the cell for further use without suffering substantial degradation or damage.

Support fabrics having uniform permeability throughout the fabric are quite suitable in diaphragms produced by the method of the present invention. Prior to impregnation with the electroactive component, these support fabrics should have a permeability to gases such as air of, for example, from about 1 to about 500, and preferably from about 50 to about 100 cubic feet per minute per square foot of fabric. However, fabrics having greater or lesser air permeability may be used. Uniform permeability throughout the support fabric is not, however, required and it may be advantageous to have a greater permeability in the portion of the support fabric which, when impregnated, will be positioned closest to the anode in the electrolytic cell. Layered structures thus may be employed as support fabrics having a first layer which when the diaphragm is installed in the cell, will be in contact with the anolyte, and a second layer which will be in contact with the catholyte. The first layer, may be, for example, a net having openings which are slightly larger than the particle size of the active ingredient with which it is impregnated.

The second layer, in contact with the catholyte when installed in the cell, may, for example, have an air permeability, for example, of from about 1 to about 15 cubic feet per minute. For the purpose of using a selected size of active component containing silica, the layered support fabric can be produced by attaching, for example, a net to a felt. The net permits the particles to pass through and these are retained on the felt.

Suitable permeability values for the support fabric may be determined, for example, using American Society for Testing Materials Method D737-75, Standard Test Method for Air Permeability of Textile Fabrics.

The support fabrics may be produced in any suitable manner. Suitable forms are those which promote absorption of the active component including sponge-like fabric forms. A preferred form of support fabric is a felt fabric.

Materials which are suitable for use as support fabrics include thermoplastic materials such as polyolefins which are polymers of olefins having from about 2 to about 6 carbon atoms in the primary chain as well as their chloro- and fluoro- derivatives.

Examples include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride, and copolymers of ethylene-chlorotrifluoroethylene.

Preferred olefins include the chloro- and fluoro- derivatives such as polytetrafluoroethylene, fluorinated ethylene-propylene, polychlorotrifluoroethylene, polyvinyl fluoride, and polyvinylidene fluoride.

Also suitable as support materials are fabrics of polyaromatic compounds such as polyarylene compounds. Polyarylene compounds include polyphenylene, polynapthylene and polyanthracene derivatives. For example, polyarylene sulfides such as polyphenylene sulfide or polynapthylene sulfide. Polyarylene sulfides are well known compounds whose preparation and properties are described in the *Encyclopedia of Polymer Science and Technology,* (Interscience Publishers) Vol. 10, pages 653–659. In addition to the parent compounds, derivatives having chloro-, fluoro-, or alkyl substituents may be used such as poly(perfluorophenylene) sulfide and poly(methylphenylene) sulfide.

In addition, fabrics which are mixtures of fibers of polyolefins and polyarylene sulfides can be suitably used.

Employing the novel method of the present invention, the support fabric is impregnated with an electroactive component such as a siliceous material. The electroactive component should be capable of undergoing hydration when in contact with the electrolytes in the electrolytic cell. A large number of siliceous materials can be used including sand, quartz, silica sand, colloidal silica, as well as chalcedony, cristobalite, and tripolite. Also suitable are alkali metal silicates such as sodium silicate, potassium silicate and lithium silicate, alkaline earth metal silicates such as magnesium silicates or calcium silicates, and aluminum silicates. In addition, a number of minerals can be suitably used as the silica-containing ingredient including magnesium-containing silicates such as sepiolites, meerschaums, augites, talcs, and vermiculites, magnesium-aluminum-containing silicates such as attapulgites, montmorillonites, and bentonites, and alumina-containing silicates such as albites, feldspars, labradorites, microclines, nephelites, orthoclases, pyrophyllites, and sodalites, as well as natural and synthetic zeolites.

When using as the electroactive component a siliceous material such as sand, quartz, silica sand, colloidal silica, chalcedony, cristobalite, tripolite, and alkali metal silicates, it may be desirable to include an additive which provides improved ionic conductivity and cation exchange properties. Suitable additives include, for example, magnesia, magnesium acetate, magnesium aluminate, magnesium carbonate, magnesium chloride, magnesium hydroxide, magnesium oxide, magnesium peroxide, magnesium silicate, magnesite, periclase, dolomites, alumina, aluminum acetate, aluminum chlorate, aluminum chloride, aluminum hydroxide, aluminum oxides ($\alpha$, $\beta$ and $\gamma$), aluminum silicate, corundum, bauxites as well as lime, lithium salts such as lithium chloride and lithium nitrate, and inorganic phosphates such as aluminum phosphates and sodium phosphates.

Other materials which may be used as electroactive components include carbon or graphite, metal oxides such as titanium oxides or zirconium oxide and tungstates or zirconates.

By the term electroactive component, as used throughout this disclosure, is meant an inorganic material having cation exchange capacity and gel forming properties.

In preparing liquid permeable diaphragms by the method of the present invention, a container such as a tank or cell can be used to hold the aqueous slurry of the electroactive component. The slurry is prepared by adding particles of the electroactive component to water or an aqueous solution of a salt such as an alkali metal chloride, to obtain a slurry containing from about 10 to about 50 percent and preferably from about 20 to about 35 percent by volume of the electroactive component.

A plurality of foraminous electrodes of the type commonly used in cells for the electrolysis of, for example, alkali metal chloride solutions are covered with the support fabric. For example, a continuous piece of support fabric may be used to cover the electrodes, the piece being sealed at certain places by known methods to prevent fluid leakage. The covered electrodes are then placed in the container. Roller means of the type shown in FIG. 2 are placed in the container and inserted in the space between two adjacent electrodes. The rollers are moved to contact the support fabric and press the electroactive component in the slurry into the support fabric. Movement of the rollers also aids in keeping the electroactive component in suspension. To provide evenly distributed pressure against the support fabric, a means of applying an outward force to the rollers may be employed. Any suitable means such as springs, hydraulic or pneumatic devices, or adjustable bars connecting the two rollers, may be used. Any pressure may be used which will impregnate the support fabric with the electroactive component. Suitable pressures include those in the range of from about 1 to about 50, and preferably from about 5 to about 10 pounds per linear foot. The rollers are connected, for example, by bars which space apart the rollers a constant distance. The bars are connected to a frame which has a handle for controlling the movement of the rollers. Rollers of any suitable length may be used and the materials of construction for the rollers include rubber, wood, plastics, etc. Roller diameters are selected to give adequate contact with the covered electrodes, each roller contacting only one of a pair of adjacent electrodes. Suitable diameters include, for example, those equal to from about $\frac{1}{4}$ to about $\frac{3}{4}$, and preferably from about $\frac{1}{2}$ to about $\frac{3}{4}$ of the space between adjacent electrodes.

In operation, the rollers are moved vertically, one roller being in contact with a face of one electrode and the second roller being in contact with a face of an adjacent electrode. It is preferred to move the rollers vigorously to impregnate the support fabric and to agitate the slurry. Where a series of electrodes are interconnected, the electrodes may be suspended from a crane or similar device which may raise and lower the electrodes to agitate the slurry.

When impregnated, the liquid permeable diaphragm produced by the method of the present invention contains from about 10 to about 75, and preferably from about 30 to about 50 milligrams per square centimeter of the active component containing silica.

Impregnated diaphragms have a permeability to alkali metal chloride brines of from about 100 to about 300, and preferably from about 150 to about 250 milliliters per minute per square meter of diaphragm at a head level difference between the anolyte and the catholyte of from about 0.1 to about 20 inches of brine.

The method of the present invention permits support fabric covered electrodes to be impregnated while positioned in the cell can or cell body. The slurry is fed into the cell and the roller means placed in the electrode interstice. Following impregnation by the method described above, the remaining slurry is drained from the cell and the cell assembled for operation.

The novel method of the present invention may be employed in producing diaphragms of the type disclosed in U.S. Pat. No. 4,165,271 which issued Aug. 21, 1979, to the applicant and patent application U.S. Ser. No. 947,235, filed Sept. 29, 1978, by the applicant, U.S. Pat. No. 4,207,163, the entire disclosure of these documents being incorporated by reference.

The novel method of the present invention is illustrated by the following EXAMPLE without any intention of being limited thereby.

EXAMPLE

A suspension of sepiolite (a magnesium-containing silicate) was prepared by the addition of the mineral to a tank containing saturated sodium chloride brine. Sufficient sepiolite was added to provide a slurry containing 25 percent by volume of sepiolite. A cathode covered by a felt fabric of polytetrafluoroethylene (duPont Company—Armalon 75-50) was placed in the tank and immersed in the slurry. A roller of the type shown in FIG. 2 was placed in the tank. The roller was inserted with the spring extended to provide a spring load of about 5 pounds per linear foot. By manually moving the rollers up and down the felt support fabric, the support fabric was impregnated with the sepiolite after about 20 movements of the roller. The rollers were moved at a rate of 10 times per minute which was sufficient to agitate the suspension and keep the sepiolite from settling out.

The impregnated felt-covered cathode was installed in an electrolytic cell containing sodium chloride brine at a concentration of 300±5 grams of NaCl per liter at a pH of 12. Current was applied at a density of 2.3 kiloamps per square meter of anode surface. Electrolysis was conducted for 50 days during which a cell liquor having a concentration of 120–145 grams per liter of NaOH was produced at a cell voltage of 3.5–3.67 volts. The cathode current efficiency was in the range of 89–93 percent.

What is claimed is:

1. A method for producing liquid permeable diaphragms for an electrolytic cell having a plurality of foraminous electrodes and a space between each pair of adjacent electrodes, said method which comprises:

(a) covering said foraminous electrodes with a liquid permeable thermoplastic support fabric, (b) contacting said covered electrodes with a slurry of an electroactive material, (c) placing roller means in said space between said pair of electrodes, said roller means comprising two rollers spaced apart, each of said rollers contacting only one of said pair of electrodes, and (d) moving said roller means within said space between said pair of electrodes to force each electroactive material into said liquid permeable thermoplastic support fabric whereby said liquid permeable diaphragms are produced.

2. The method of claim 1 in which said slurry has a concentration of from about 10 to about 50 percent by volume of said electroactive material.

3. The method of claim 1 in which an outward force is applied to said rollers.

4. The method of claim 1 in which said rollers have a diameter equal to from about $\frac{1}{4}$ to about $\frac{3}{4}$ of the space between said pair of electrodes.

5. The method of claim 3 or 4 in which said liquid permeable thermoplastic support fabric is a polyolefin selected from the group consisting of olefins having 2 to about 6 carbon atoms and their chloro- and fluoro-derivatives.

6. The method of claim 3 or 4 in which said electroactive material is selected from the group consisting of magnesium silicates, sepiolites, meerschaums, augites, talcs, vermiculites, and mixtures thereof.

7. The method of claim 6 in which said liquid permeable diaphragm has a concentration of said electroactive component of from about 10 to about 75 milligrams per square centimeter of said liquid permeable thermoplastic support fabric.

8. The method of claim 3 in which said outward force applied to said roller is from about 1 to about 50 pounds per linear foot.

9. The method of claim 5 in which said liquid permeable thermoplastic support fabric is a polyolefin selected from the group consisting of polypropylene, polytetrafluoroethylene, fluorinated ethylenepropylene, polychlorotrifluoroethylene, polyvinyl fluoride, and polyvinylidene fluoride.

10. The method of claim 2 in which said liquid permeable thermoplastic support fabric is a polyarylene sulfide selected from the group consisting of polyphenylene sulfide, polynaphthalene sulfide, poly(perfluorophenylene) sulfide, and poly(methylphenylene) sulfide.

* * * * *